US006245477B1

(12) United States Patent
Ray et al.

(10) Patent No.: US 6,245,477 B1
(45) Date of Patent: Jun. 12, 2001

(54) IMAGABLE COMPOSITIONS AND PRINTING FORMS

(75) Inventors: Kevin B. Ray, Morley; Alan S. V. Monk, Warrington, both of (GB)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/365,495

(22) Filed: Aug. 2, 1999

(51) Int. Cl.[7] ..... G03C 1/72

(52) U.S. Cl. ..... 430/138; 430/270.1; 430/302; 101/457; 101/463.1; 101/467

(58) Field of Search ..... 430/270.1, 302, 430/41, 138; 101/463.1, 467, 456, 457

(56) References Cited

U.S. PATENT DOCUMENTS

| | | | | |
|---|---|---|---|---|
| 4,271,249 | | 6/1981 | Gilliams et al. | 430/101 |
| 5,688,629 | | 11/1997 | Gries | 430/254 |
| 5,741,619 | * | 4/1998 | Aoshima et al. | 430/175 |
| 5,768,995 | | 6/1998 | Miyaguchi et al. | 101/463.1 |
| 5,768,996 | | 6/1998 | Ackley | 101/483 |
| 5,922,506 | * | 7/1999 | Hoogmartens et al. | 430/273.1 |
| 6,001,536 | * | 12/1999 | Vermeersch et al. | 430/302 |
| 6,022,667 | * | 2/2000 | Vermeersch et al. | 430/271.1 |
| 6,030,750 | * | 2/2000 | Vermeersch et al. | 430/302 |

FOREIGN PATENT DOCUMENTS

| | | |
|---|---|---|
| 0559257 | 9/1993 | (EP) . |
| 0738932 | 10/1996 | (EP) . |
| 881096 | 12/1998 | (EP) . |
| 0898205 | 2/1999 | (EP) . |
| 0901045 | 3/1999 | (EP) . |

OTHER PUBLICATIONS

Research Disclosure 33303, Jan. 1992, A Lithographic Printing Plate, J. Vermeersch.*

* cited by examiner

*Primary Examiner*—Hoa Van Le
*Assistant Examiner*—Barbara Gilmore
(74) *Attorney, Agent, or Firm*—Baker Botts L.L.P.

(57) ABSTRACT

Heat-imagable negative working lithographic printing forms employ negative working heat sensitive compositions comprising a water soluble binder and particles of pigment in association with a thermoplastic resin. Heat causes fusion of the particles to the binder. Heated regions are thereby rendered insoluble to aqueous developers. Unheated areas are soluble in developer or fount solutions, so development may take place "on-press" during the initial phase of a print run.

28 Claims, No Drawings

IMAGABLE COMPOSITIONS AND PRINTING FORMS

BACKGROUND OF INVENTION

The present invention relates to negative working lithographic printing form precursors, to their use and to imagable compositions for use thereon.

The art of lithographic printing is based on the immiscibility of ink, generally an oily formulation, and water, wherein in the traditional method the ink is preferentially retained by the image or pattern area and the water or fount solution is preferentially retained by the non-image or non-pattern area. When a suitably prepared surface is moistened with water and an ink is then applied, the background or non-image area retains the water, while the image area accepts ink and repels the water. The ink on the image area is then transferred to the surface of a material upon which the image is to be reproduced, such as paper, cloth and the like. Commonly the ink is transferred to an intermediate material called the blanket which in turn transfers the ink to the surface of the material upon which the image is to be reproduced.

New types of "waterless" lithographic printing employ only an oily ink material and preferentially ink-accepting image areas and ink-repelling non-image areas on the printing form.

A generally used type of lithographic printing form precursor (by which it will be understood to mean a coated printing form prior to exposure and development) has a radiation sensitive coating applied to an aluminum substrate. Negative working lithographic printing form precursors have a radiation sensitive coating which when imagewise exposed to radiation of a suitable wavelength hardens in the exposed areas. On development, the non-exposed areas of the coated composition are removed, thereby leaving the image. In contrast, positive working lithographic printing form precursors have a radiation sensitive coating, which after imagewise exposure to radiation of a suitable wavelength becomes more soluble (in a developer) in the exposed areas than in the non-exposed areas. In both cases only the image area on the printing form itself is ink-receptive.

The differentiation between image and non-image areas is made in the exposure process where a film has typically been applied to the printing form precursor with a vacuum to ) ensure good contact. The printing form precursor is then flood exposed by a radiation source. In the case where a positive form precursor is used, the area of the film that corresponds to the image in the printing form precursor is opaque so that no light will strike the printing form precursor, whereas the area on the film that corresponds to the non-image area is clear and permits the transmission of light to the coating, which becomes more soluble and is removed on development.

The coatings are normally laid down as solutions in an organic solvent, which is removed by evaporation.

The radiation source has conventionally been an ultraviolet (UV) radiation source. Recently infrared (IR) radiation sources have become of interest.

In many proposals the compositions contain IR absorbers which convert IR radiation to heat, and it is the heat which is the direct cause of the solubility change in the composition. A heated body delivering heat conductively to corresponding compositions not containing IR absorbers can likewise effect the solubility change. A suitable IR radiation source is an IR laser digitally controlled to produce the required pattern of heated areas. Thus, these methods do not employ flood exposure through a film. Some of these type of compositions are suitable for advanced "Computer-To-Plate" (CTP) techniques, and also are not additionally sensitive to ultra-violet or visible radiation. These composition thus offer the advantage, over traditional photosensitive recording compositions, that they do not need to be handled in a dark room, or under ultra-violet safelighting conditions, but can simply be handled in ordinary light.

Conventionally, the imaged precursor undergoes a development step, typically by immersion in an alkaline developer such as sodium metasilicate in water, often in a dedicated plate processor, to remove the more soluble areas and yield the printing form, ready for use.

Some systems rely on adhesion of a "stripping layer" to an imaging element. After imagewise exposure, the stripping layer is peeled away, removing non-exposed areas of the imaging element. The step of peeling away the stripping layer removes the need for a separate liquid development step.

In U.S. Pat. No. 5,688,629, a photosensitive material is disclosed, for use in the production of lithographic printing plates, comprising a support, a hydrophilic layer, a photopolymerisable layer and a stripping layer. On imagewise exposure to actinic radiation, the adhesion of the photopolymerisable layer to the hydrophilic layer and/or the stripping layer is changed. Subsequent peeling away of the stripping layer leads to removal of either the exposed or unexposed parts of the photopolymerisable and hydrophilic layers, depending on the composition, to provide positive or negative lithographic printing plates.

EP-A-738932 discloses an imaging element comprising a hydrophilic surface, a hydrophobic composition containing a photosensitive acid generator and a transfer layer. After imagewise exposure of the imaging element using UV radiation, a receptor layer is laminated, either by heat or pressure, to the transfer layer, and the receptor layer is then peeled away to remove unexposed areas of the photosensitive composition.

In EP-A-559 257, recording materials are disclosed comprising a support, a porous layer of an image forming substance, a substance capable of converting radiation to heat, a thermoplastic layer and a stripping layer. Imagewise heating may be achieved using an IR laser delivered through the support. During imagewise heating, the porous layer adheres to the support and the thermoplastic layer softens, thereby penetrating the porous layer. The recording material is subsequently overall exposed to UV or short-wavelength visible radiation through the stripping layer in order to cure the thermoplastic layer. The stripping layer is peeled away, removing the unexposed areas and leaving an image of the porous layer on the support.

U.S. Pat. No. 5,768,996 discloses a lithographic printing plate formed without a separate liquid development step, and which is intended for waterless printing. It employs toner particles from photocopiers or laser printers. In this method the desired image is formed on a master paper substrate with toner, for example using a laser printer in its usual way. A layer of silicone rubber is then applied over the entire surface bearing the toner and subsequently the silicone rubber layer is "shaved" to reveal the ink-receptive toner underneath, and leave exposed toner areas, ink receptive, and silicone areas, ink repellent.

An object of the present invention is to provide a simple negative-working thermally imagable composition suitable for a lithographic printing form precursor. Objects of preferred embodiments of the present invention include: providing such a precursor which can be water or fount solution developed, thus including on-press, during printing; providing a composition and precursor which employs toner particles as radiation absorber; and providing a composition which can be laid down as a coating from an aqueous solution, thus avoiding the need to remove an organic solvent by evaporation.

SUMMARY OF THE INVENTION

The negative working heat sensitive composition of this invention comprises a water-soluble binder having particles therein, with the particles further comprising a pigment in association with a thermoplastic resin. The heat sensitive composition may be provided on a substrate as a dry coating such that the solubility of the coating in aqueous developer is decreased upon heating to the extent that the solubility difference of the coating when heated and unheated enables the coating to be used to provide a thermally created image upon development due to the solubility difference between the heated and unheated portions of the coating. The heating is provided by exposure of the pigment portion of the particles contained in the binder to electromagnetic radiation, which is absorbed by the particles and converted to heat. The thermoplastic resin portion of the particles is melted by the heat, thereby rendering the radiation exposed portions of the coating less soluble in the developer solution than the non-exposed portions of the coating, and enabling the invention to be useful in negative working lithographic printing. The invention is also directed to a lithographic printing form precursor comprising a substrate having a hydrophilic surface and a coating applied to the hydrophilic surface, where the coating comprises the negative working heat-sensitive composition of this invention. The invention is also directed to a method of making a printing form comprising delivering heat pattern-wise to the printing form precursor of this invention, and thereafter applying an aqueous developer to the coating, and to such a printing form.

DETAILED DESCRIPTION OF THE INVENTION

According to this invention, there is provided a negative working heat-sensitive composition comprising a water-soluble binder and particles therein, the particles comprising a pigment in association with a thermoplastic resin. The heat sensitive composition has the property that it can be provided on a substrate as a dry coating whose aqueous developer solubility is decreased on heating.

Suitable "particles" for use in the present invention are insoluble in the water-soluble binder and in an aqueous developer.

The pigment component of the particles is suitably a black body or broad band absorber, preferably able efficiently to absorb electromagnetic radiation and convert it to heat over a range of wavelengths, preferably exceeding 200 nm in width, more preferably exceeding 400 nm in width.

Suitable pigments include carbon, phthalocyanine pigments, and inorganic pigments. Examples include black iron (III) oxide, manganese oxide, MILORI BLLE (C.I Pigment Blue 27) available from Aldrich, HELIOGEN GREEN available from BASF, NIGROSINE BASE NG1 available from NH Laboratories Inc, and carbon pigments.

Carbon pigments are preferred, and grades are available under various names including carbon black, lamp black, channel black and furnace black.

Examples of thermoplastic resins which may be present in the particles employed in the present invention include polyolefins, polyesters, polyacrylics and polystyrene, as homopolymers, copolymers or terpolymers. Preferred thermoplastic resins are styrene-acrylic acid copolymers and styrene-butadiene copolymers.

The essential components of the particles are the pigment, to absorb radiation and produce heat, and the thermoplastic resin, to be melted by the heat. However, other components, such as waxes and free-flowing agents (such as colloidal silica or zinc stearate), and/or other materials which aid manufacturing handling, storage or imaging may be present, as will be well understood by those skilled in the art.

Toner particles suitable for use in photocopiers, laser printers and the like are suitable for use as the particles of the present invention and are preferred. Further information about toner particles may of course be found in many published sources. Examples include U.S. Pat. No. 4,271,249, EP 901045 and EP 898205, all of which are incorporated herein by reference.

Suitable as the binder is any material which, when in the form of a dry coating containing the particles is soluble in a selected developer; and which is rendered insoluble in the developer by melting of the particles therein. Preferably the binder is miscible with water so that after mixing with particles it can be laid down as a coating from an aqueous formulation which is then dried by evaporation of water.

Suitable water-soluble binders include polyvinyl alcohols, acrylic resins, including carboxylic acid-acrylate ester copolymers, polyvinyl phosphonic acids, hydroxyalkylcelluloses, dextrins, gums and rosins.

Thus the water soluble binder is suitably provided in aqueous solution, and may be mixed with the particles to form a liquid composition in accordance with the first aspect. This may be coated onto a substrate and dried to form a dry form of the composition, also in accordance with a preferred embodiment of the invention. A sufficient quantity of particles should be provided to render a dry coating of the composition insoluble in the selected developer, on heating. This quantity is easily determined by those skilled in the art, but in general the weight ratio of particles to binder (dry) is suitably in the range 10:1 to 1:2 preferably 5:1 to 1:1, especially 3:1 to 3:2.

The compositions of the invention may contain other ingredients such as stabilizing additives, inert colorants, and additional inert polymeric binders as are present in many lithographic plate compositions, and as are well known to those skilled in the art.

Although there may be other materials present, the preferred embodiments of these compositions, once dried, contain only the particles and the binder. Preferred liquid compositions additionally contain water.

The particles are preferably of size <50 microns, as measured by grind gauge, preferably <30 microns.

In accordance with another embodiment of the present invention there is provided a lithographic printing form precursor comprising a substrate with a hydrophilic surface and above the hydrophilic surface a coating, the coating comprising a negative working heat-sensitive composition as defined above. Preferably the coating is obtained by application of the composition in aqueous liquid form to the surface followed by drying.

The hydrophilic substrate may be an aluminum plate which has undergone the usual graining, anodizing and post-anodic treatments well known in the lithographic art for enabling a heat or radiation sensitive composition to be coated thereon and for the surface of the support to function as a printing background.

Another base material which may be used is a plastics material base or a treated paper base as used in the photographic industry. A particularly useful plastics material base is a polyester which has been treated or prepared (e.g. "subbed") to render its surface hydrophilic. Also so-called resin coated paper which has been corona discharge treated can be used.

Suitably the coating has a coating weight of at least 0.5 $gm^{-2}$, preferably at least 1 $gm^{-2}$. Suitably the coating weight does not exceed 5 $gm^{-2}$, and preferably it does not exceed 3 $gm^{-2}$.

In accordance with another embodiment of the present invention there is provided a method of making a printing form, comprising the patternwise delivery of heat to a printing form precursor of this invention, as already disclosed, followed by the application of an aqueous developer to the coating, to remove unheated areas.

The coated precursors may be heat imaged using a heated body. For example the heat sensitive composition itself, or the reverse side of a precursor, may be contacted with a heat stylus.

In preferred methods of the invention electromagnetic radiation is used to expose the coating, the wavelength thereof preferably entirely or predominantly exceeding 500 nm. Preferably, it is of wavelength entirely or predominantly exceeding 600 nm. More preferably it is of wavelength entirely or predominately exceeding 700 nm. Most preferably it is of wavelength entirely or predominantly exceeding 800 nm. Suitably it is of wavelength entirely or predominantly below 1400 nm. More preferably it is of wavelength predominantly or entirely below 1200 nm. Most preferably it is of wavelength entirely or predominantly below 1150 nm. Thus, suitably it is of wavelength entirely or predominantly in the range 600 to 1400 nm, more preferably 700 to 1200 nm, most preferably 800 to 1150 nm.

Preferably a laser under digital control is used to heat the coating patternwise.

Preferably the coating is only developable by heat, and has no, or insignificant, photosensitivity. Preferably, therefore, it can be handled in daylight or under ordinary room lighting.

In accordance with another embodiment of the present invention there is provided a printing form produced by the above-described method. Suitably the remaining areas of coating are ink-accepting.

The aqueous developer may be an aqueous alkaline developer but a preferred aqueous developer is water, as distinct from an aqueous alkaline developer. "Water" as used herein includes water with minor additives, for example surfactants, which do not render the water of pH in excess of 10, and preferably not in excess of 8. A preferred pH range for the aqueous developer is 5–9, most preferably 5.5–8, and especially 6–7.5.

A preferred developer is the fount solution applied to the printing form at the commencement of printing. Such a fount solution is well known to those skilled in the art. Thus, a preferred method of the present invention does not employ a distinct development step between imaging and printing. Rather, development takes place "on-press" in preferred embodiments. Accordingly in another embodiment of the invention there is provided a printing process carried out on a precursor as defined above and which has been heat imaged, the printing process employing a fount solution which effects development by removing areas of the coating which have not been heated.

As used herein, the statement that the aqueous developer solubility of the coating is decreased on heating means that the solubility of the coating is substantially decreased upon heating by an amount useful in negative working lithographic printing process.

While not wishing to be limited by any theoretical explanation of how the claimed invention operates, it is believed that on application of heat, the thermoplastic resin component of the particles fuses with the water-soluble binder. The fusion product of the particles and water-soluble binder is thus rendered insoluble in the aqueous developer.

Any feature of any aspect of the present invention or embodiment described herein may be combined with any feature of any other aspect of any invention or embodiment described herein.

The following examples more particularly serve to illustrate the various aspects of the present invention described herein above.

The following products are referred to hereinafter:

GLASCOL HN 4—an aqueous solution of a carboxylic acid/acrylate ester as supplier by Allied Colloids of Bradford, UK.

Photocopier Toner—toner from a T-25 1 OE cartridge (suitable for use in a Toshiba 2550 photocopier), as supplied by Toshiba Systems (France), Neultra-violetille Les Dieppe, France.

Laser Printer Toner—toner from a Kores 502207 cartridge (suitable for use in a Ricoh 6000 laser printer), that has been recycled and re-filled with toner by Lasercharge UK, Leeds, UK.

Imagesetter A—this uses a rotatable disc of diameter 105 mm that can be rotated at a constant speed of 120 revolutions per minute. Adjacent to the rotatable disc, a translating table holds a laser beam source so that it impinges normal to the disc, and the translating table moves the laser beam radially in a linear fashion with respect to the rotatable disc. The exposed image is in the form of a spiral whereby the image in the center of the spiral represents slow laser scanning speed and long exposure time. The laser used is a single mode 830 nm wavelength 200 mW laser diode which was focused to a 10 micron spot. The laser power supply was a stabilized constant current source.

Soldering iron—a Weller soldering iron EC 2100 M at 311° C.

Substrate A—a 0.3 mm thickness sheet of aluminum that has been electrograined and anodised and post-anodically treated with an aqueous solution of an inorganic phosphate.

EXAMPLE 1

The following mixture was ball-milled for 72 hours, having a grind of <5 micron, as measured by grind gauge:

| Component | % W/W |
|---|---|
| GLASCOL HN4 | 19.3 |
| Water | 60.7 |
| Photocopier toner | 20 |

Precursors were prepared by coating the formulation onto Substrate A by means of a wire wound bar. The formulation concentration was selected to provide a dry film having a coating weight of 2.0 $gm^{-2}$. The plates were dried at 70° C. for 4 minutes in a Mathis labdryer oven (as supplied by Werner Mathis AG, Germany). The plates were then cut into discs of 105 mm diameter, imaged on Imagesetter A, and subsequently washed with cold water, which removed the non-imaged area of the coating. A visible spiral of oleophilic, imaged coating was retained up to the edge of each disc. Additional samples were imaged using the soldering iron at a speed of 1 $cms^{-1}$ over the coated face of each sample and washed in water. Again an oleophilic image area was seen.

EXAMPLE 2

The following mixture was ball-milled for 78 hours, having a grind of <25 micron, as measured by grind gauge:

| Component | % W/W |
|---|---|
| GLASCOL HN4 | 19.3 |
| Water | 60.7 |
| Laser Printer Toner | 20 |

Precursors were prepared by coating the formulation onto Substrate A by means of a wire wound bar. The formulation concentration was selected to provide a dry film having a coating weight of 2.0 $gm^{-2}$. The plates were dried as in Example 1. The plates were then imaged on Imagesetter A, and subsequently washed with cold water, which removed the non-image area. A continuous spiral of oleophilic, imaged coating was retained on the plate up to 25 mm radius from the centre of the disc and thereafter a broken spiral was present to the edge of the disc. The invention is not restricted to the details of the foregoing embodiments. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drings), may be replaced by alternative features serving the same, equivalent or similar purpose, unless expressly stated otherwise. Thus, unless expressly stated otherwise, each feature disclosed is one example only of a generic series of equivalent or similar features.

We claim:

1. A negative working heat-sensitive composition comprising a water-soluble binder and particles therein, wherein each of the particles comprises a pigment component and a thermoplastic resin component and the heat sensitive composition is capable of being provided on a substrate as a dry coating such that the aqueous developer solubility of the dry coating is decreased on heating.

2. The composition as claimed in claim 1, wherein the water-soluble binder is selected from the group consisting of polyvinyl alcohols, acrylic resins, polyvinyl phosphonic acids, hydroxyalkylcelluloses, dextrins, gums and rosins.

3. The composition as claimed in claim 1, wherein the pigment is a carbon pigment.

4. A composition as claimed in claim 1, wherein the thermoplastic resin is selected from the group consisting of styrene-acrylic acid copolymers and styrene-butadiene copolymers.

5. The composition as claimed in claim 1 wherein the particles are toner particles.

6. A lithographic printing form precursor comprising: (a) a substrate having a hydrophilic surface; and (b) a coating applied to the hydrophilic surface, the coating comprising a negative working heat-sensitive composition comprising a water-soluble binder and particles therein, wherein each of the particles comprises a pigment component and a thermoplastic resin component and the heat sensitive composition is capable of being provided on a substrate as a dry coating such that the aqueous developer solubility of the dry coating is decreased on heating.

7. The precursor of claim 6, wherein the water-soluble binder is selected from the group consisting of polyvinyl alcohols, acrylic resins, polyvinyl phosphonic acids, hydroxyalkylcelluloses, dextrins, gums and rosins.

8. The precursor of claim 6, wherein the pigment is a carbon pigment.

9. The precursor of claim 6, wherein the thermoplastic resin is selected from the group consisting of styrene-acrylic acid copolymers and styrene-butadiene copolymers.

10. The precursor of claim 6 wherein the particles are toner particles.

11. A method of making a printing form, comprising: (a) providing a printing form precursor comprising (i) a substrate having a hydrophilic surface, and (ii) a coating applied to the hydrophilic surface, the coating comprising a negative working heat-sensitive composition comprising a water-soluble binder and particles therein, wherein each of the particles comprises a pigment component and a thermoplastic resin component and the heat sensitive composition is capable of being provided on a substrate as a dry coating such that the aqueous developer solubility of the dry coating is decreased on heating; (b) delivering heat patternwise to the printing form precursor; and (c) applying an aqueous developer to the coating.

12. The method of claim 11, wherein the water-soluble binder is selected from the group consisting of polyvinyl alcohols, acrylic resins, polyvinyl phosphonic acids, hydroxyalkylcelluloses, dextrins, gums and rosins.

13. The method of claim 11, wherein the pigment is a carbon pigment.

14. The method of claim 11, wherein the thermoplastic resin is selected from the group consisting of styrene-acrylic acid copolymers and styrene-butadiene copolymers.

15. The method of claim 11, wherein the particles are toner particles.

16. The method of claim 11, wherein the delivery of heat is achieved by exposing the coating to electromagnetic radiation of wavelength exceeding 500 nm.

17. The method of claim 11, wherein the aqueous developer is water.

18. The method of claim 17, wherein the aqueous developer is fount solution, and the development is carried out on a printing press during the initial phase of a printing run.

19. A printing form prepared by the method comprising: (a) providing a printing form precursor comprising (i) a substrate having a hydrophilic surface, and (ii) a coating applied to the hydrophilic surface, the coating comprising a negative working heat-sensitive composition comprising a water-soluble binder and particles therein, wherein each of the particles comprises a pigment component and a thermoplastic resin component and the heat sensitive composition is capable of being provided on a substrate as a dry coating such that the aqueous developer solubility of the dry coating is decreased on heating; (b) delivering heat patternwise to the printing form precursor; and (c) applying an aqueous developer to the coating.

20. The printing form of claim 19, wherein the hydrophilic surface is exposed on removal of unheated areas of the coating by the developer, and remaining areas of the coating are ink-accepting.

21. The printing form of claim 19, wherein the water-soluble binder is selected from the group consisting of polyvinyl alcohols, acrylic resins, polyvinyl phosphonic acids, hydroxyalkylcelluloses, dextrins, gums and rosins.

22. The printing form of claim 19, wherein the pigment is a carbon pigment.

23. The printing form of claim 19, wherein the thermoplastic resin is selected from the group consisting of styrene-acrylic acid copolymers and styrene-butadiene copolymers.

24. The printing form of claim 19 wherein the particles are toner particles.

25. A negative working heat-sensitive composition comprising a water-soluble binder and toner particles therein, the particles comprising a pigment and a thermoplastic resin and the heat sensitive composition is capable of being provided on a substrate as a dry coating such that the aqueous developer solubility of the dry coating is decreased on heating.

26. A lithographic printing form precursor comprising: (a) a substrate having a hydrophilic surface; and (b) a coating applied to the hydrophilic surface, the coating comprising a negative working heat-sensitive composition comprising a water-soluble binder and toner particles therein, the particles comprising a pigment and a thermoplastic resin and the heat sensitive composition is capable of being provided on a substrate as a dry coating such that the aqueous developer solubility of the dry coating is decreased on heating.

27. A method of making a printing form, comprising: (a) providing a printing form precursor comprising (i) a substrate having a hydrophilic surface, and (ii) a coating applied to the hydrophilic surface, the coating comprising a negative working heat-sensitive composition comprising a water-soluble binder and toner particles therein, the particles comprising a pigment and a thermoplastic resin and the heat sensitive composition is capable of being provided on a substrate as a dry coating such that the aqueous developer solubility of the dry coating is decreased on heating; (b) delivering heat patternwise to the printing form precursor; and (c) applying an aqueous developer to the coating.

28. A printing form prepared by the method comprising: (a) providing a printing form precursor comprising (i) a substrate having a hydrophilic surface, and (ii) a coating applied to the hydrophilic surface, the coating comprising a negative working heat-sensitive composition comprising a water-soluble binder and toner particles therein, the particles comprising a pigment and a thermoplastic resin and the heat sensitive composition is capable of being provided on a substrate as a dry coating such that the aqueous developer solubility of the dry coating is decreased on heating; (b) delivering heat patternwise to the printing form precursor; and (c) applying an aqueous developer to the coating.

* * * * *

UNITED STATES PATENT AND TRADEMARK OFFICE

CERTIFICATE OF CORRECTION

PATENT NO. : 6,245,477 B1
DATED : June 12, 2001
INVENTOR(S) : Ray et al.

It is certified that error appears in the above-identified patent and that said Letters Patent is hereby corrected as shown below:

Title page,
Item [56], Reference Cited, U.S. PATENT DOCUMENTS: "5,768,996 6/1988 Ackley … 101/483" should be deleted Column 1,
Line 45, ")" should be deleted Column 2,
Line 5, "composition" should read -- compositions --

Column 3,
Line 58, "BLLE" should read -- BLUE --

Column 7,
Line 37, "drings" should read -- drawings --

Signed and Sealed this

Sixth Day of August, 2002

*Attest:*

*Attesting Officer*

JAMES E. ROGAN
*Director of the United States Patent and Trademark Office*